United States Patent [19]

Orlandoni

[11] 4,352,310

[45] Oct. 5, 1982

[54] PORTABLE KEYBOARD MUSICAL INSTRUMENT

[76] Inventor: Franco Orlandoni, 1 Crossley Pl., Park Ridge, N.J. 07056

[21] Appl. No.: 163,637

[22] Filed: Jun. 27, 1980

[51] Int. Cl.[3] ..... G10H 1/00; G10C 3/12

[52] U.S. Cl. ..... 84/1.01; 84/424; 84/432

[58] Field of Search ..... 84/1.01, 424, 432, 1.17, 84/1.16

[56] References Cited

U.S. PATENT DOCUMENTS 4,078,464 3/1978 Sugiyama ..... 84/DIG. 3

4,241,636 12/1980 Long ..... 84/1.03

FOREIGN PATENT DOCUMENTS 1285279 12/1968 Fed. Rep. of Germany ... 84/DIG. 3

*Primary Examiner*—J. V. Truhe

*Assistant Examiner*—Forester W. Isen

*Attorney, Agent, or Firm*—Sheldon H. Parker

[57] ABSTRACT

The portable keyboard musical instrument employs two hollow tubes with either keyboards in each or one keyboard and one button cord unit, connection means at either end, a collar means with which to secure the two tubes and end caps to close off the non-connected ends. The instrument weighs only a few pounds and can be carried by the player much like a guitar when connected end to end, or like an accordian when connected side by side. The sound which can be obtained is only limited by the desired electronics and the instrument can be connected to the amplifiers by cable or remote.

15 Claims, 16 Drawing Figures

61
62
63
64
60
15A
13
18
20
12
17
11
19
84
81

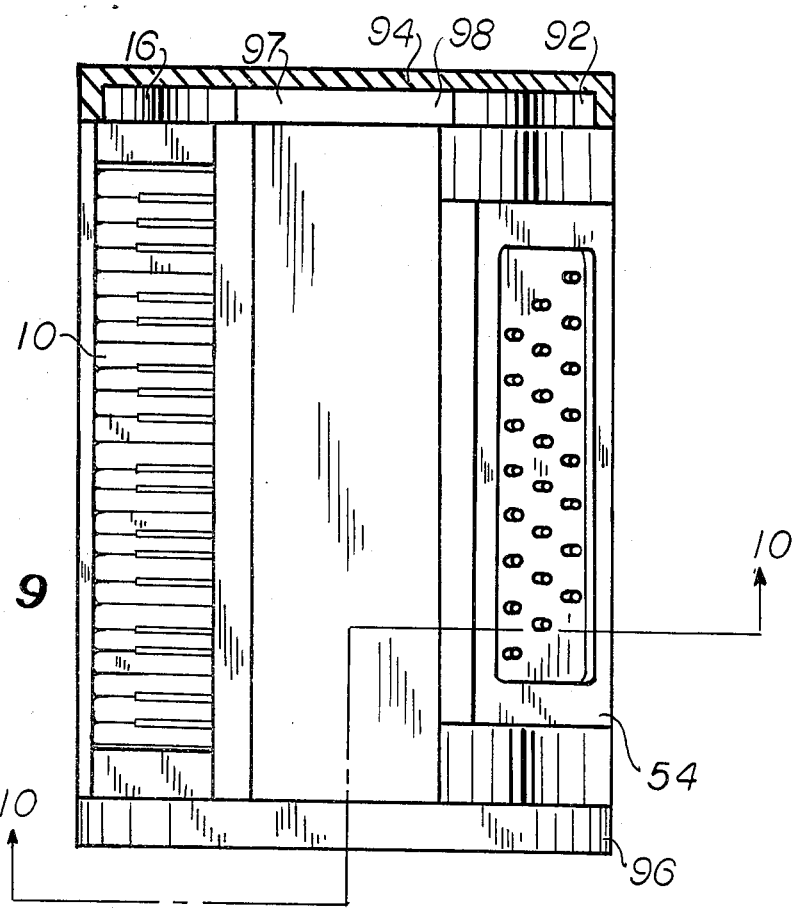
FIG 9
FIG 4
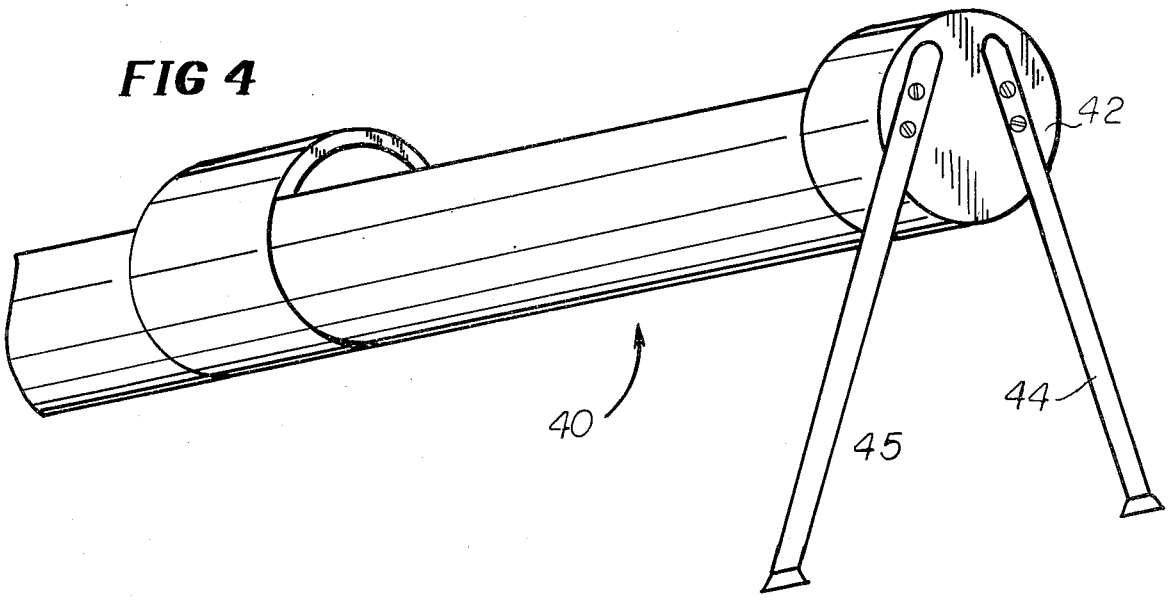

FIG. 16
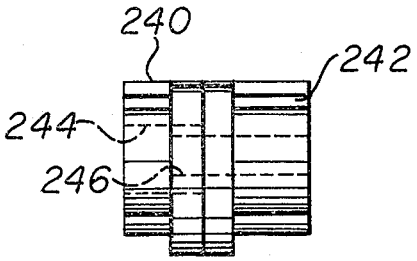
FIG. 13
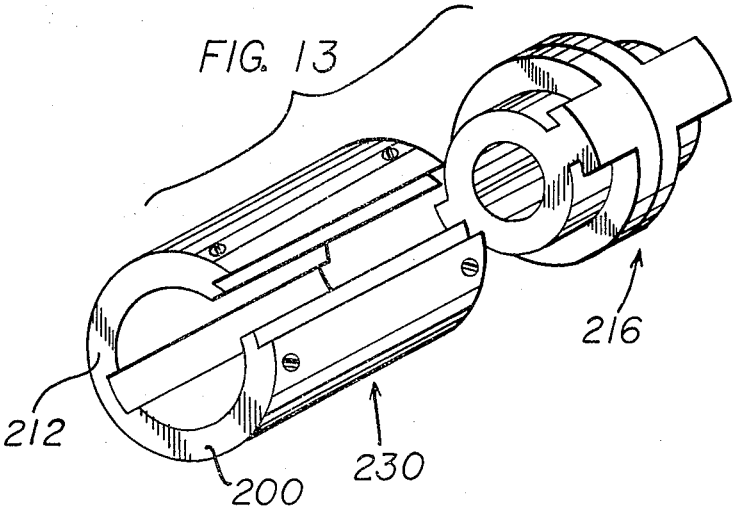
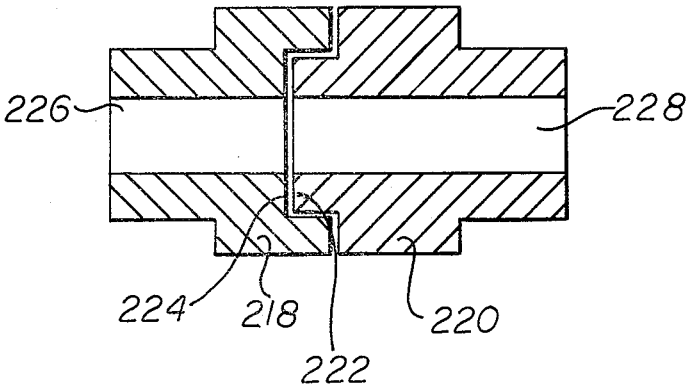
FIG. 12

PORTABLE KEYBOARD MUSICAL INSTRUMENT

BACKGROUND OF THE INVENTION

1. Field of the Invention

The instant invention relates to improvements on a lightweight, portable keyboard instrument which allows the player to move around freely while providing quality and variety of sound which is limited only by the available electronics.

2. Brief Description of the Prior Art

In recent years many patents have issued and much work has been done in the field of electronic musical instruments, not only to enable instruments to create new sounds, but to free the performer to move around the stage or through the audience.

A remote control electronic system is disclosed extensively in U.S. Pat. No. 4,099,437 which covers the connecting a musical instrument, mainly keyboard type, to an amplifier. Further reference to this system will be incorporated later herein.

Some portability is disclosed in U.S. Pat. No. 3,698,276, wherein the entire unit can be collapsed and conveniently moved from location to location. This prior art organ cannot, however, be easily moved around on stage and cannot be moved by the user while playing. With the advent of increased interaction between performers and their audiences, there has been a greater tendency for many performers to leave the stage at times and to move through the audience, speaking to individual persons in the audience and playing musical selections for them. This trend has been accelerated by the advent of wireless microphones, which eliminate the restriction of movement caused by the microphone cable between a performer and his remote amplifier unit.

This method of entertainment, in which a performer moves through an audience and plays musical selections as he moves about, has heretofore been limited to the use of musical devices which were relatively light in weight and sufficiently small in bulk to be portable. Typical devices used by performers moving about in their audiences might be accordians, guitars, violins, small wind instruments, etc.

Because of the obvious size and weight limitations of the musical equipment which a performer can carry as he moves through an audience, it is not possible for such a performer to play relatively bulky and heavy musical devices which produce more impressive, desirable, or preferred sounds, such as pianos or organs. Thus there is a need for a musical system whereby a performer may carry a relatively light weight, relatively small remote unit as he moves through an audience or otherwise moves about, and thereby control the operation of a remote musical device, e.g. a keyboard musical instrument such as piano or organ. Preferably, such a system should employ a wireless communication link between the portable control unit and the remote portions thereof, to eliminate the need for a cumbersome and restrictive cable connection between the same or at least be light weight and require a modest cable connection.

Although systems have been devised for the automatic or remote control of keyboard musical instruments by means of wire data links between the control source and the musical device being played, there has been little or no attention given by practitioners of the electronic musical instrument art to the development of a light weight keyboard devices which can be carried and connected to the bulky electronics by either light cable or wireless control.

For example, the automatic playing of pianos has been a well developed art for over fifty years, the most well known examples of this art being player pianos controlled by perforated paper rolls. In the player piano art there is also known as accessory unit, such as that of U.S. Pat. No. 1,109,554, which can be detachably secured to a piano above the keys thereof, to automatically depress predetermined keys, by means of electrically controlled solenoid devices. U.S. Pat. No. 883,252 shows a bracket arrangement for detachably mounting a piano action, i.e. a playing device to be disposed immediately above the piano keyboard, with facilities for adjusting the bracket position to align the piano action with the underlying piano keyboard keys. These patents are hereby incorporated into this application by reference thereto, to the extent they disclose features applicable to embodiments of the invention herein described.

U.S. Pat. No. 3,709,085 shows a teaching device in which a remote keyboard is provided which is coupled by wires to an elongated housing disposed above the keyboard of a keyboard musical instrument. The housing includes a plurality of solenoids, one solenoid being positioned above each key of the musical instrument to be played, so that in one mode of operation a teacher can play the remote keyboard musical device will be depressed by the remotely controlled solenoids mounted within the elongated housing positioned over the instrument keyboard. See in particular FIG. 15 of this patent and the corresponding discription at column 6, lines 38 to 65. To the extent it is applicable to embodiments of the invention herein described, the disclosure of this patent is incorporated herein by reference thereto.

U.S. Pat. No. 3,610,802 shows an accordian-organ in which the organ electronics and speaker are located in a remote unit connected to the accordian-organ control units by wires.

U.S. Pat. No. 3,825,666 shows a system in which a guitar includes the equivalent of a wireless microphone, i.e. the audio output of the guitar is transduced and radiated to a remote receiver, the output of which drives a speaker. Only the audio signal generated by the guitar is transmitted. There is no transmission of data corresponding to discrete keys, functions, or desired musical sounds.

The use of multiplex techniques and computer storage and retrieval in conjunction with electronic organs is well known in the art. For example, U.S. Pat. No. 3,905,267 shows an arrangement for utilizing multiplex techniques to transform the key depressions of an organ (corresponding to a musical composition being played on the organ) into a digital code. The code is then recorded on a tape recorder, for later playback through a decoder which drives solenoids to depress the organ keys to replay the original composition.

U.S. Pat. Nos. 3,915,047 and 3,926,088 describe arrangements in which an organ is electronically coupled to a computer by wires and the organ keys being depressed during a performance are converted into digital data which is stored or analyzed by the computer scheme for displaying the music in musical notation as it is played by the performer.

U.S. Pat. No. 3,968,716 shows a keyboard instrument employing multiplex transmission by wires from the keyboard to remote tone generators (multiplex is employed to reduce the number of wires needed), and wireless transmission of the audio information from the tone generators to remote speakers. Like U.S. Pat. No. 3,825,666 this system does not employ wireless transmission of data corresponding to particular keys or musical sounds to be reproduced.

Multiplex schemes for multiplexing the information as to which keys are being depressed during a performance on an organ are also described in U.S. Pat. Nos. 3,875,842, 3,899,951 and 3,916,750, none of which employ an asynchronous organ key scanning arrangement employed in the embodiment of the instant invention hereafter described; however, as will become apparent upon studying the detailed description of said embodiment which follows, there are differences in implementation between said patent and the aforementioned embodiment.

Starting with the big bands of yesteryear to the rock bands of today, the best known member of the band has been the person in front of the audience, the person who could move around and play directly to the audience. This is even more obvious with the guitar players of the rock bands of today. The guitar players move to the music, walk to the edge of the stage to converse with the audience and develop a rapport with their fans, expecially to the opposite sex. Heretofore the players of the large instruments, the piano, organ and synthesizer, have been trapped at the back of the stage, relatively unknown and unnoticed by their fans.

The accordian, once a popular instrument and capable of producing a pleasant, unique sound, has dwindled in popularity. some reasons for this loss may be the lack of "sex appeal", the weight and the limited control of sound caused by the manual operation of the bellows.

All of the heretofore mentioned problems have been overcome in the instant invention by use of a lightweight, portable, multi-sound and multi-positioned keyboard unit.

BRIEF DESCRIPTION OF THE DRAWINGS

The objects and advantages of the invention will become apparent from the following detailed description of the invention, particularly when read in conjunction with the drawings, wherein:

FIG. 4 is an end view of an alternate embodiment of the instant invention;

FIG. 9 is an alternate embodiment of the instant invention;

FIG. 12 is a cutaway view of the rotational joint;

FIG. 13 is a perspective view of the mounting channel and connecting bracket;

FIG. 16 is a perspective view of mounting bracket.

SUMMARY OF THE INVENTION

In the instant invention the foregoing complications and inadequacies are overcome and a light-weight, easy to manufacture and versatile keyboard musical instrument is produced. The instrument includes two hollow tubes, each having a cut out section, in which the keyboard is secured, and connector sections at each end. The tubes are placed either end to either end as desired and secured with a collar; with the non-connected ends closed with end caps.

In another embodiment of the invention, one of the two hollow tubes is fitted with an accordian type cord button unit, replacing one of the keyboards. The tubes can then be placed either end to end and secured as above, or placed side by side secured with end caps having slidable adjusting means.

DETAILED DESCRIPTION OF THE INVENTION

Figures 1, 2, 6, 8:
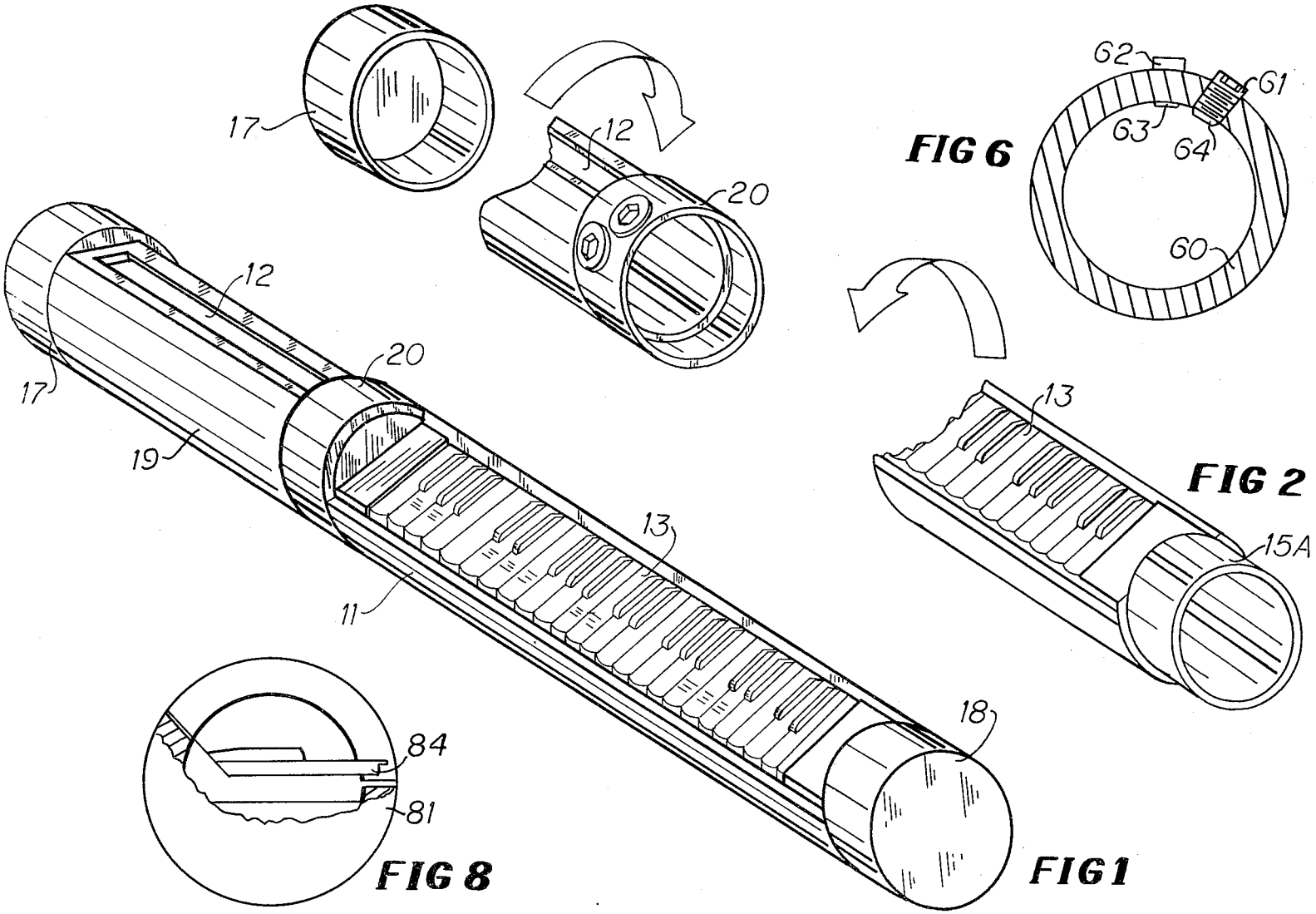
FIG. 1 is a view of the two preferred embodiment of the instant invention.
FIG. 2 is a fragmentary view of the connection portions of the preferred embodiment of the instant invention.
FIG. 6 is a perspective view of the connecting collar.
FIG. 8 is a cutaway view of the keyboard inset.

In FIG. 1 the two keyboard units 12 and 13 are shown connected. The cylindrical containers 11 and 19 are formed from a hollow cylindrical tube of a diameter large enough to accomodate the internal wiring and to support a keyboard. A diameter of approximately six inches is preferred, however this or any other dimensions provided in the instant application are provided as approximate or suggested dimensions and should in no way limit the application. In addition, the further reference to cylindrical tube is not intended to limit the instant application. As used herein the term tubular is intended to be inclusive of any hollow, elongated member having a non-circular, circular or polygonal cross-section. The term cylindrical is most commonly used in specific reference to tubes of circular cross-section and is the preferred configuration due to ease of manufacture, aesthetic appeal and maximum convenience in use. However, even a triagular or oval configuration can be used, preferably in combination with a circular connecting collar. The use of non-circular mating connecting elements can be used but with the disadvantage of reducing the selectable relative positions of the tubes to a finite number and would necessitate separation of the tubes and connecting collar each time an adjustment is made of the relative keyboard orientation.

Figure 3:
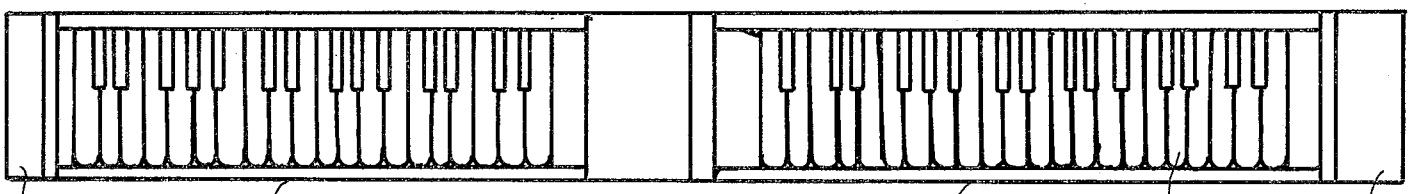
FIG. 3 is another embodiment of the instant invention.
Figure 5:
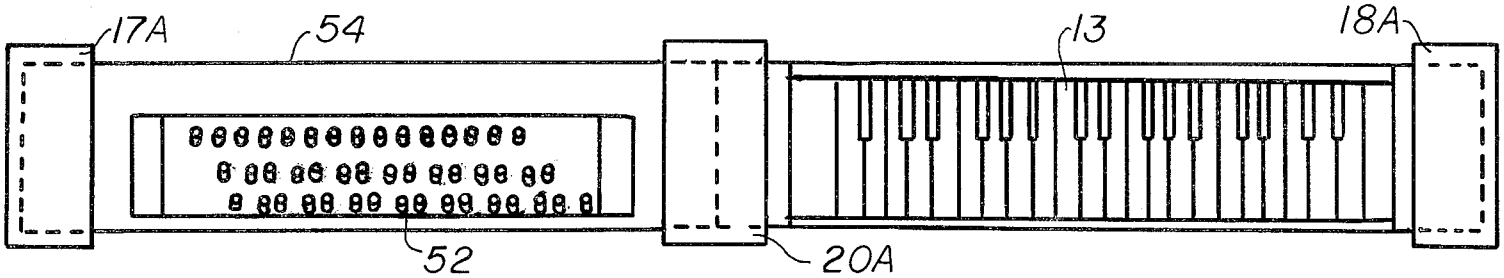
FIG. 5 is an additional embodiment of the instant invention.

The length of the cylindrical containers 11 and 19 are long enough to accomodate an accordian sized keyboard plus several inches on each end to provide rigidity and structural support. The keyboard units 12 and 13 are, at one end, recessed into a cutout of the cylindrical containers 11 and 19, with the opposite end of the keyboard units 12 and 13 resting on the cylindrical containers 11 and 19. This will be described in more detail later herein in conjunction with FIG. 8. At either end of the cylindrical units 11 and 19 are the connectors dimensionally matching the connector 15A of FIG. 2. The connectors are of a cylindrical shape and are of a smaller or equal diameter to the cylindrical containers 11 and 19 as illustrated in FIG. 5. Again, it should be noted that the term cylindrical is used as the preferred embodiment of the connectors but does not limit the use of other shapes in forming the connectors 15A. The connectors 15A are placed in a position abutting each other and are held together securely by use of a collar 20. The configuration of the collar 20 is described in detail in FIGS. 6 and 7. The collar 20 secures the cylindrical containers 11 and 19 in a multiple number of positions as shown in FIGS. 1 and 3. In FIG. 2 connector 15A is shown prior to the addition of the end cap 18. The end caps 17 and 18 are used to seal off the non-connected end of the cylindrical units 11 and 19 when not abutting another connector. The use of connectors 15A at either end of the cylindrical containers 11 and 19 provides the versatility of connecting the cylindrical containers 11 and 19 at either end to obtain further versatility of positions. End caps 17 and 18 of FIG. 1 are shown in the fixed position, closing off the connector.

FIGS. 1 and 3 illustrate two of the many different positions which can be obtained by the various end to end combinations of the cylindrical units 11 and 19. FIG. 1 shows the cylindrical units 11 and 19 positioned so as to have the keyboards 12 and 13 accessible to playing in a guitar position. Keyboard 13 would be played from the side closest to the body with the right hand, keyboard 14 would be played furthest from the body with the left hand. A shoulder strap (not shown) would be attached to the end caps 17 and 18 and the entire unit would be held and carried like a guitar. This arrangement would allow a piano, organ or synthesizer player to move freely around the stage or room, as does the guitar player, with little or no effort required in learning the positioning of the instrument.

In FIG. 3 the keyboards 13 and 14 are arranged in standard piano fashion. Set as such it provides an easily moved piano, organ, etc., which can be placed on legs 44 and 45 as described in FIG. 4, or worn with a harness as used with many band instruments and well known in the prior art. The use of the instrument with legs allows the player, because of the compact construction, to be in the front of the stage, however, there is no freedom of movement while playing which may or may not be a disadvantage, depending upon the player. If mobility is desired or required, the harness can be attached and used in that fashion.

FIG. 4 illustrates the keyboard instrument 40 with the legs 44 and 45 attached to the end cap 42. The end cap 42 is identical to the end caps 17 and 18 of previous figures except for the addition of legs. The legs 44 and 45 can be fashioned in one straight piece of polystyrene, or other suitable plastic, wood or lightweight hollow metal. It is preferred, however, that they be of a telescoping construction to allow for adjustment of height and ease of packing. The attachment of the legs 44 and 45 to the end cap 42 can be of any number of methods and would depend upon convenience of manufacture, costs, etc and are shows herein as being affixed by screws.

In FIG. 5 the keyboard unit is oriented as in FIG. 3, however the keyboard 14 has been replaced by accordian cord buttons 52. The cylindrical button unit 54 is identical in every way to the cylindrical unit 13 except for the replacement of the keyboard 12 with the buttons 52. As set in this manner, the keyboard instrument 50 can be used with one of the previously described keyboard units 13 with only the addition of the button unit 54, thus allowing for two different types of instruments with only the addition of one unit. The keyboard unit 50 can be used as either an organ or accordian type instrument and can be set on legs or carried as described previously. All of the positions, including FIGS. 1 and 3, can be incorporated with the keyboard instrument 50.

FIG. 6 shows one embodiment of the collar 60 used to hold the cylindrical units 12 and 13, or cylindrical unit 12 and button unit 54, together. The collar has a interior diameter equal to or only slightly larger than that of the outer diameter of the connectors as shown as 15A of FIG. 2. The outer diameter of the collar 60 must be sufficient to provide strength and support and, aesthetically should be flush with the outer diameter of the cylindrical containers 11 and 19. In FIG. 5, however, the collar 20A is shown with a larger outer diameter than the cylindrical containers 11 and 19 for structural convenience and ease of manufacture. Once in place over the connectors, the screws 63 and 64 are screwed into predrilled holes in the connectors via the screw heads 61 and 62, thus locking the two keyboard units together in a desired position. As indicated by the arrows, each unit can be rotated relative to the other so as to maximize user comfort.

Figure 7:
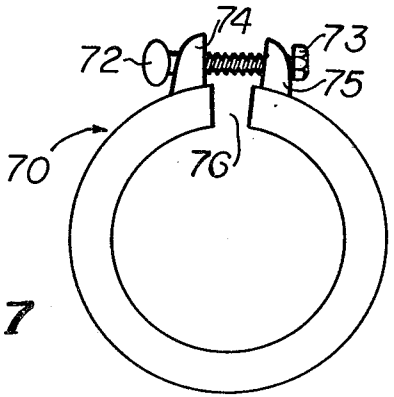
FIG. 7 is a perspective view of an alternate connecting collar.

FIG. 7 is an alternate collar 70 which is shown herein as an end view. At one section of the collar 70, lengthwise through end to end, is the tightening allowance 76, a space cut in the circular configuration of the collar 70, which should be of sufficient size to allow for substantial tightening, but not of such a size as to weaken the collar 70. The collar 70 is formed as a compression member, of the type commonly used to tighten hoses. As evident, the bolt 72 and nut 73 can interact to control or vary the distance between the flanges 74 and 75 and consequently increase or decrease the diameter of the collar 70. Decreasing the diameter of the collar 70 causes the collar 70 to exert an increased pressure against the connectors thus securing them in the desired position.

FIG. 8 shows a sectional side view of the cylindrical container 81 showing the cut away section of the cylinder allowing for the placement or insertion of the keyboard 84. The keyboard 84 is held in place and padded in the standard manner as well known in the art for the placement of accordians, pianos, etc. The amount of cylinder cut away must allow for the clearance required to play the keyboard 84. It is suggested that an arc of at least 90° but less than 180° be used.

FIG. 9 is an alternate embodiment to the keyboard-/button combination. The musical unit 10 and button unit 54 are placed side by side, in accordian cycle. A slot 97 can run end to end or as shown, a pair of slots 97 and 98 can be used, within the end cap 94 providing slidable adjustment of the connectors 16 and 92 in order to allow the button unit 54 and the musical unit 10 to be spaced appropriately, based on personal preference. The slots 97 and 98 have a diameter equal to or slightly larger than that of the connectors 16 and 92 in order to fit snugly when applied. End cap 96 is shown in position. The means for fastening the connectors 16 and 92 to the end cap 94 can be by frictional force, screws placed in predrilled holes in the connector ends or any other method convenient for manufacture.

Figure 10:
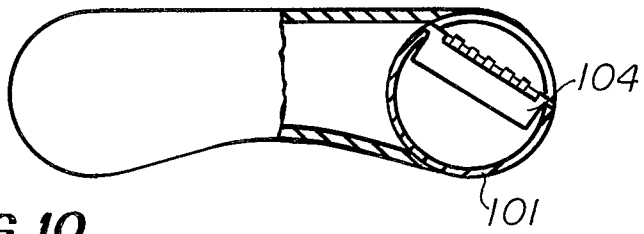
FIG. 10 is a perspective view of the top of the connection cap of the instant invention.

FIG. 10 shows a section of the cylindrical container 101 has been cut and the buttons 104 fit within the cutout. The buttons 104 can be attached to the cylindrical container 101 in the conventional manner as well known in the accordian prior art. The size of the cut region of the cylinder will correspond directly to the size of the buttons 104.

Figure 11:
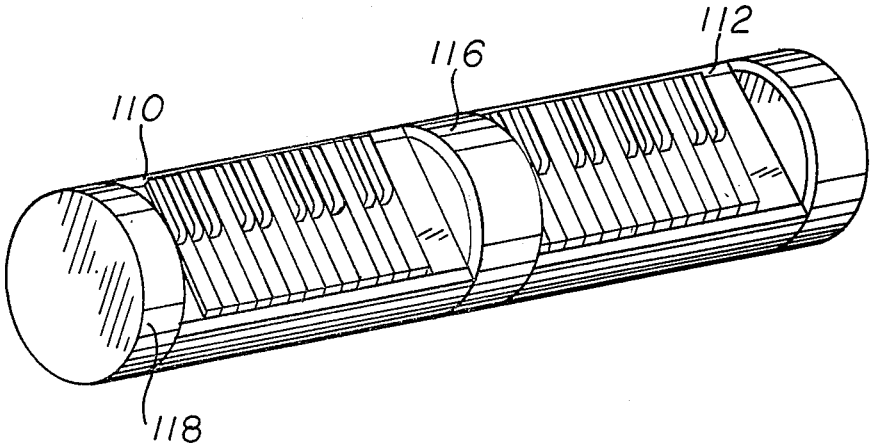
FIG. 11 is a perspective view of a non-circular embodiment of the invention.

FIG. 11 illustrates only one of the many alternate configurations which can be used instead of the cylindrical shape. Keyboard units 110 and 112 are of an oval cross-section with the end cap 118 formed in the same shape. The connectors (not shown) are of a circular cross-section to allow for the previously described adjusting convenience. The collar 116, as shown in FIG. 11, also has the circular cross-section, it could however, be constructed with the circular interior and the oval exterior. The shapes which the tubes can take are almost limitless and it should be noted that, for some purposes, the mixing of shapes can be desirable.

The wiring for all of the above described units is contained in the hollow cylindrical containers 11 and 19 and are on an electrical connection basis as described in the prior art, either with cables or remote as described in U.S. Pat. No. 4,099,437. The amplifying sound unit can be equipted to provide any desired sound, piano, drums, organ, etc., and is only limited by electronic capabilities and desired expense.

The use of a tube to contain the electronic components and support the piano keys, chord buttons, electronic controls, etc., necessitates machining efforts to convert the tube to a finished component of the musical instrument. Thus, the tube which is a readily available commercial "stock" item can prove to result in a high cost because the manufacturing operation becomes labor intensive.

The use of a mounting channel 230, formed as a continuous extrusion or casting from a light weight metal such as aluminum or a rigid plastic such as polyvinylchloride, or a clear plastic such as polymers or copolymers of acrylic acid sold under the trademarks Plexiglas by Rohm & Haas Co., or Lucite by DuPont de Nemours, E.I. & Co., permits mounting brackets or the like to be included as an integral part of the mounting channel 200. Structural foam from polyethylene or other plastics produces extremely light weight instruments.

The bracket 212 is merely illustrative of the form which can be provided and obviously can be dimensioned and positioned to correspond to the type and shape of the internal eletronic components and wiring. Thus, the machining of finished or shaped edges, and installation of support brackets, rails or the like is eliminated, or at least minimized, as well as eliminating the need to provide a tube with a longitudinal slot somewhat shorter in length than the tube length.

The mounting channel 230 can have any desired cross-sectional shape such as square, rectangular or other polygons, as well as being oval, circular, elliptical or any combination thereof.

As shown in FIG. 12, the rotational joint 216 of FIG. 13 is formed from two halves 218 and 220 which have a rotationally fitting or cooperating regions 222 and 224. As illustrated, section 222 is received within section 224 of the rotational joint 216. The interior passages 226 and 228 provide passage means between the mounting channels 230 and 232 (not shown) for electrical cables if required.

Figure 14:
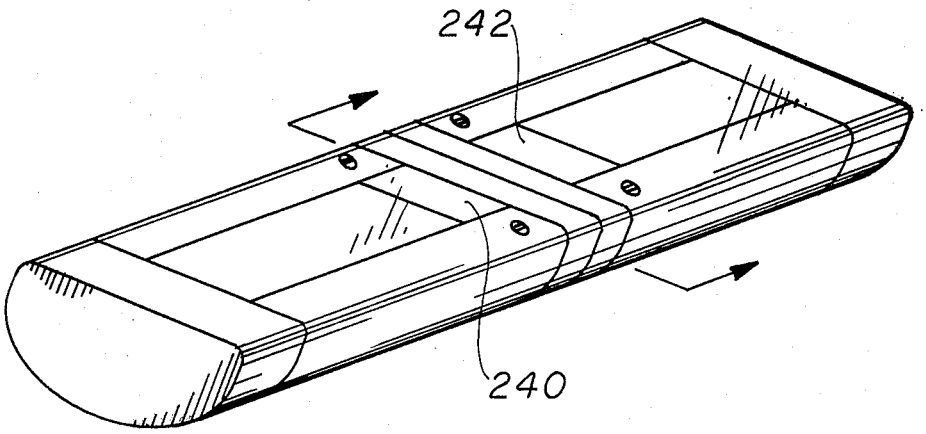
FIG. 14 is an alternate embodiment of the instant invention.
Figure 15:
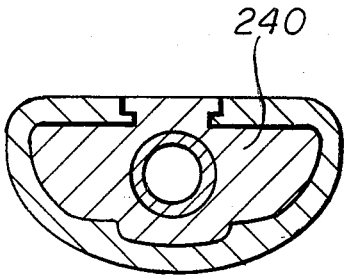
FIG. 15 is cutaway end view of a mounting bracket.

Alternatively, the rotational joint can be an internal element formed of two halves 240 and 242, as illustrated in FIGS. 14, 15 and 16, having circular cross-sectional male and female elements 244 and 246.

The end caps can have any desired cross-sectional configuration matching or contrasting with that of the mounting channels.

As previously set forth, the mounting channels can contain a variety of components known in the prior art.

What is claimed is:

1. A portable keyboard instrument comprising two hollow tubes, a. each tube having a cut out section, a first end section and a second end section;

b. at least one of said two hollow tubes having electronic key board means affixed to said cut out section of said tubes;

c. a pair of removable end cap means, each end cap means of said pair of end cap means being secured to an end section;

d. a connecting member means, said connecting member means being dimensioned for releasably locking together, alternatively said second end sections of said two hollow tubes said first end sections of said two hollow tubes, or a first end section and a second end section of said two hollow tubes, each end cap means of said pair of end cap means being secured to an end section which is not releasably locked to another end section.

2. The portable keyboard instrument of claim 1 wherein said two hollow tubes are of substantially equal diameter.

3. The portable keyboard instrument of claim 2 wherein said cut out section has an arc at least 90° but less than 180°.

4. The portable keyboard instrument of claim 2 wherein said end cap means are dimensioned to fit over said first end section of each of said two hollow tubes, said first end section and said second end section are of substantially the same diameter.

5. The portable keyboard instrument of claim 1 wherein said connecting member has rotatable securing means with which to selectively secure said connecting member to an end section of each of said two hollow tubes, whereby one of said two hollow tubes can be rotated relative to the other of said two hollow tubes to a predetermined position in any end to end combination.

6. The portable keyboard instrument of claim 5 wherein said rotatable securing means is a third hollow tube having two ends, each end being dimensioned to releasably and rotatably receive either the first end section or the second end section of said two hollow tubes, said rotatable securing means further including releasable locking means at each end, each of said locking means being capable of precluding relative movement of said third hollow tube and each of said two hollow tubes whereby the end to end and rotational orientation of said tubes can be altered as desired.

7. The portable keyboard instrument of claim 1 wherein said end caps are fitted over the first end section of each of said two hollow tubes.

8. The portable keyboard instrument of claim 6 wherein said releasable locking means includes a pair of compression members locking said two hollow tubes in a multiplicity of positions.

9. The portable keyboard instrument of claim 1 wherein the hollow tube is of circular cross-section.

10. In an electrical instrument, a. A first elongated mounting chanel having open ends and an elongated longitudinal opening;

b. a first end cap closing a first end of said first channel;

c. first electronic actuator means mounted in said elongated longitudinal opening;

d. a second elongate mounting channel having open ends elongated longitudinal opening e. a second end cap closing a first end of said second channel;

f. second electronic actuator means mounted in the elongated longitudinal opening of said second mounting channel;

g. rotational connector means associated with the second open end of said first mounting channel and the second open end of said second mounting channel for providing rotation of said first elongate mounting channel about its longitudinal axis, relative to said second elongate mounting channel, and for securing said first and second channels in the thus rotated position.

11. The electrical instrument of claim 10, wherein said first electronic actuator means are electrical switches in the form of piano keys.

12. A control device for causing an electronic music synthesizer to produce predetermined musical tones in response to the actuation of a plurality of electrical switches, comprising, a first mounting member having a first open end, a second open end, and an opening for receiving a first group of electrical switches, a first end closure releasably connected to and closing said first open end of said first mounting member, a second mounting member having a first open end, a second open end and an opening for receiving a second group of electrical switches, a second end closure releasably connected to and closing said first end of said second mounting member, a rotational connector means connected to the second open end of said first mounting member and releasably connected to the second open end of said second mounting member and providing for rotation of said first mounting means relative to said second mounting means and for securing said first and second channels in the thus rotated position.

13. The control device of claim 12, wherein said rotational connector means is releasably connected to said second open end of said first mounting means.

14. The control device of claim 13, wherein said rotational connector means has a first connection end and a second connection end, both of which are dimensioned and configured to releasably connect to each of said first open end and said second open end of said first mounting means and said first open end and said second open end of said second mounting means.

15. The electrical instrument of claim 14, wherein said rotational connector has a first end which mates with and releasably connects to said second open end of said first mounting channel and a second end which mates with and releasably connects to said second open end of said second mounting channel, and a rotational joint between said rotational connector first end and second end.

* * * * *